US009833080B1

(12) United States Patent
Ray

(10) Patent No.: US 9,833,080 B1
(45) Date of Patent: Dec. 5, 2017

(54) ERGONOMIC LATERAL RECUMBENCY SUPPORT APPARATUS AND SYSTEM

(71) Applicant: Dennis Ray, Edmond, OK (US)

(72) Inventor: Dennis Ray, Edmond, OK (US)

( * ) Notice: Subject to any disclaimer, the term of this patent is extended or adjusted under 35 U.S.C. 154(b) by 116 days.

(21) Appl. No.: 14/706,179

(22) Filed: May 7, 2015

Related U.S. Application Data

(60) Provisional application No. 61/992,427, filed on May 13, 2014.

(51) Int. Cl.
*A47C 20/02* (2006.01)
*A47C 20/00* (2006.01)
*A47G 9/10* (2006.01)

(52) U.S. Cl.
CPC ..... *A47C 20/027* (2013.01); *A47C 20/021* (2013.01); *A47G 2009/1018* (2013.01)

(58) Field of Classification Search
CPC ..... A47C 16/00; A47C 16/005; A47C 20/00; A47C 20/02; A47C 20/025; A47C 20/026; A47C 20/027; A47C 20/021; A47G 9/10; A47G 9/1072; A47G 2009/1018; A61G 7/07; A61G 7/0755
See application file for complete search history.

(56) References Cited

U.S. PATENT DOCUMENTS 3,901,228 A * 8/1975 Brown ..... A61F 13/069 128/882
5,153,960 A * 10/1992 Ritter ..... A47G 9/10 27/13
5,163,194 A * 11/1992 Dixon ..... A47G 9/1081 5/636
5,163,195 A * 11/1992 Hill ..... A47G 9/10 5/637
5,722,102 A * 3/1998 Summers ..... A47C 7/425 297/452.29
8,347,435 B2 * 1/2013 Yu ..... A47G 9/10 5/490
9,021,635 B1 * 5/2015 Leach ..... A47C 20/02 5/630
2005/0229315 A1 * 10/2005 Walpin ..... A47C 20/027 5/633

* cited by examiner

*Primary Examiner* — Nicholas Polito
(74) *Attorney, Agent, or Firm* — Phillips Murrah PC; Martin G. Ozinga

(57) ABSTRACT

The present invention provides a lateral recumbency back support designed to support various portions of the body generally comprising a contoured and flexible foam wedge design allowing flexibility at all points along the length of same and having sufficient firmness to provide support for the desired portion of the body.

6 Claims, 10 Drawing Sheets

ERGONOMIC LATERAL RECUMBENCY SUPPORT APPARATUS AND SYSTEM

CROSS-REFERENCE TO RELATED APPLICATIONS

Priority is claimed from provisional patent application U.S. Ser. No. 61/992,427 filed on May 13, 2014, and incorporated by reference herein.

BACKGROUND OF THE INVENTION

1. Field of the Invention

In general, the present invention relates to a new and improved ergonomic multi-functional backrest wedge and pillow having the capability of assuming a series of different configurations. More particularly, the present invention provides a lateral recumbency back support designed to support various portions of the body generally comprising a contoured flexible foam wedge design allowing flexibility at all points along the length of same and having sufficient firmness to provide support for the desired portion of the body as well as ventilation and cooling channels. It is understood that the invention may be utilized for support other than lateral recumbency and may include a therapeutic heating and or cooling element.

2. Description of the Prior Art

It is not uncommon for people to have to or want to stay and or sleep on their side. This position is generally referred to as a lateral recumbent position. Often it is necessary or desirable under a variety of circumstances for a person to lie on their side in a position that does not allow them to take advantage of human anatomical structures that would allow the person to rest on their side in a more semi-lateral position with minimal effort. When a person needs to maintain their position lying on their side without leaning back to rest on some of the larger muscles in the rear and portions of the shoulder, this position can cause strain to muscles in the lumbar region of the back, pelvic region, stomach, legs and hips, and fatigue from the effort required to maintain this non-resting position in lateral recumbency.

A person may desire or need to maintain their body in such a position that includes, but are not limited to, post-surgery, pregnancy, breast feeding while lying down, keeping pressure off injured tissue as in the case of hemorrhoids, burns and abrasions, stabilizing a lateral recumbency position for post-surgical needs, therapeutic treatments such as topical agents, heat, cold packs, to alleviate pressure sores and or wounds, and so forth. It is therefore desirable for people who must spend extended periods of time in a lateral recumbency position to utilize pillows, wedges, and so forth to support the body at strategic points to lessen the discomfort from that position when inadequately supported. It is especially desirable to provide support that may flex to match the natural curves of the user's spine.

One attempt to provide support in the prior art is to utilize numerous flat pillows placed at the point of need. In order to effectuate this practice, it is common for people to roll, twist and fold flat pillows and place them at the strategic locations to alleviate the suffering. The aforementioned procedure of utilizing numerous pillows results in significant time, need for storage space for the pillows, and expense with providing this necessary procedure. It is not unusual to use four to six pillows to achieve the desired lateral recumbency support. Furthermore, the pillows oftentimes unroll upon the user's movements, thereby requiring additional time to reroll, re-twist and refold the flat pillows.

In the prior art, numerous types of foam wedge designs have been utilized in attempt to provide the proper lateral support. Unfortunately, these wedge designs are typically non-dynamic and generally fixed and non-flexible. These prior art devices are also typically just foam cut into a wedge that cannot be flexed to ergonomically contour to a user's side.

Although there are currently numerous specialty pillows and wedges on the market that claim to provide ergonomic support for a lateral recumbent position, these prior art are devices fail to provide the desired support. Those requiring lateral recombency support are looking for effective, durable, and cost effective apparatus and systems. Thus, there is a need for a new and improved, apparatus, system and method of use as discussed above. The current invention provides a new and improved ergonomic lateral recumbency support apparatus and system that will provide those in need with the support desired.

SUMMARY OF THE INVENTION

In view of the foregoing disadvantages inherent in the known types of pillows, wedges, mattresses, and systems of use now present in the prior art, the present invention provides a convenient, easily used and durable construction. As such, the general purpose of the present invention, which will be described subsequently in greater detail, is to provide a new and improved ergonomic lateral recumbency support apparatus and system, which has all the advantages of the prior art and none of the disadvantages.

To attain such, the present invention generally provides a foam spine that may comprise a plurality of generally trapezoidal segments that are connected to allow flexion and contouring around a user's back, torso, spine, pelvic region, and so forth. It is further contemplated that the foam spine may be enclosed in an inner cover, also utilize an outer cover, and combinations thereof. Outer cover may be made of a surface to provide friction to hold the foam spine in a desired position and foam spine may further include a support inner core segment. It is further contemplated the current invention may be utilized with a heating pad and or element. Still furthermore, the current invention contemplates utilization with a cooling element and or ice pack. It is also understood that the current invention may be utilized to provide support to a user in other positions than just lateral recumbency. The current invention may be utilized for sitting, leg support, and so forth.

It is also contemplated that the invention may allow multiple degrees of supported recumbence, which may aid relief on downward shoulder joints. Further, the invention may provide wrap around pelvic support.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ergonomic lateral recumbency support apparatus and system that allows for support along the user's spine and may flex and or contour accordingly.

Another object of the present invention is to provide a new and improved ergonomic lateral recumbency support apparatus and system, which is of a durable and reliable construction and may be utilized for support other than a lateral recumbent position.

It is also a further object of the present invention to provide a new and improved ergonomic lateral recumbency support apparatus and system that is susceptible to a low cost of manufacture with regard to both materials and labor, and which accordingly is then susceptible to low prices of sale to the consuming industry, thereby making such valve economically available to those in need.

An even further object of the present invention is to provide a new and improved ergonomic lateral recumbency support apparatus and system, which may be easily and efficiently utilized, manufactured and marketed.

Still another object of the present invention is to provide a new and improved ergonomic lateral recumbency support apparatus and system, which provides all of the advantages of the prior art, while simultaneously overcoming some of the disadvantages normally associated therewith.

A further object of the present invention is to provide a new and improved ergonomic lateral recumbency support apparatus and system that may include easily removable and cleanable covers that are fitted and constructed of a breathable, waterproof and durable fabric according to healthcare standards.

Another object of the present invention is to provide a new and improved ergonomic lateral recumbency support apparatus and system, which may be utilized with a heating pad, a cold pack, and combinations thereof.

Yet another object of the present invention is to provide a new and improved ergonomic lateral recumbency support apparatus and system, which is designed to stay in the desired position by utilizing a friction surface as well as segments that may be laid upon to further anchor the apparatus where desired.

An even further object of the present invention is to provide a new and improved ergonomic lateral recumbency support apparatus and system that is generally lightweight for positioning.

Still another object of the present invention is to provide a new and improved ergonomic lateral recumbency support apparatus and system, which promotes airflow and air circulation around the user and the apparatus wherein the apparatus has vertical cooling and vent channels.

Another object of the present invention is to provide a new and improved ergonomic lateral recumbency support apparatus and system, which may be utilized as a barrier for use with a bed to prevent a user from falling off the bed, into an unwanted position on the bed, and so forth.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

It is also understood the present invention referred to throughout may be embodied in other specific forms without departing from its spirit or essential characteristics. The described embodiments are to be considered in all respects only as illustrative and not restrictive. Furthermore, each of the embodiments that have been described should also be considered only as illustrative and not restrictive.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, exhibits and appendices.

DETAILED DESCRIPTION OF THE PREFERRED EMBODIMENTS

In a preferred embodiment, the current invention may include the following although it is contemplated that combinations may be utilized to provide the ergonomic lateral recumbency support as generally referred to in the application and illustrations described below. The current invention may be classified as an apparatus, system, method and/or combinations thereof. The following detailed description does not define any aspect in a particular order of importance but rather attempts to organize the following for convenience only.

Figure 1:
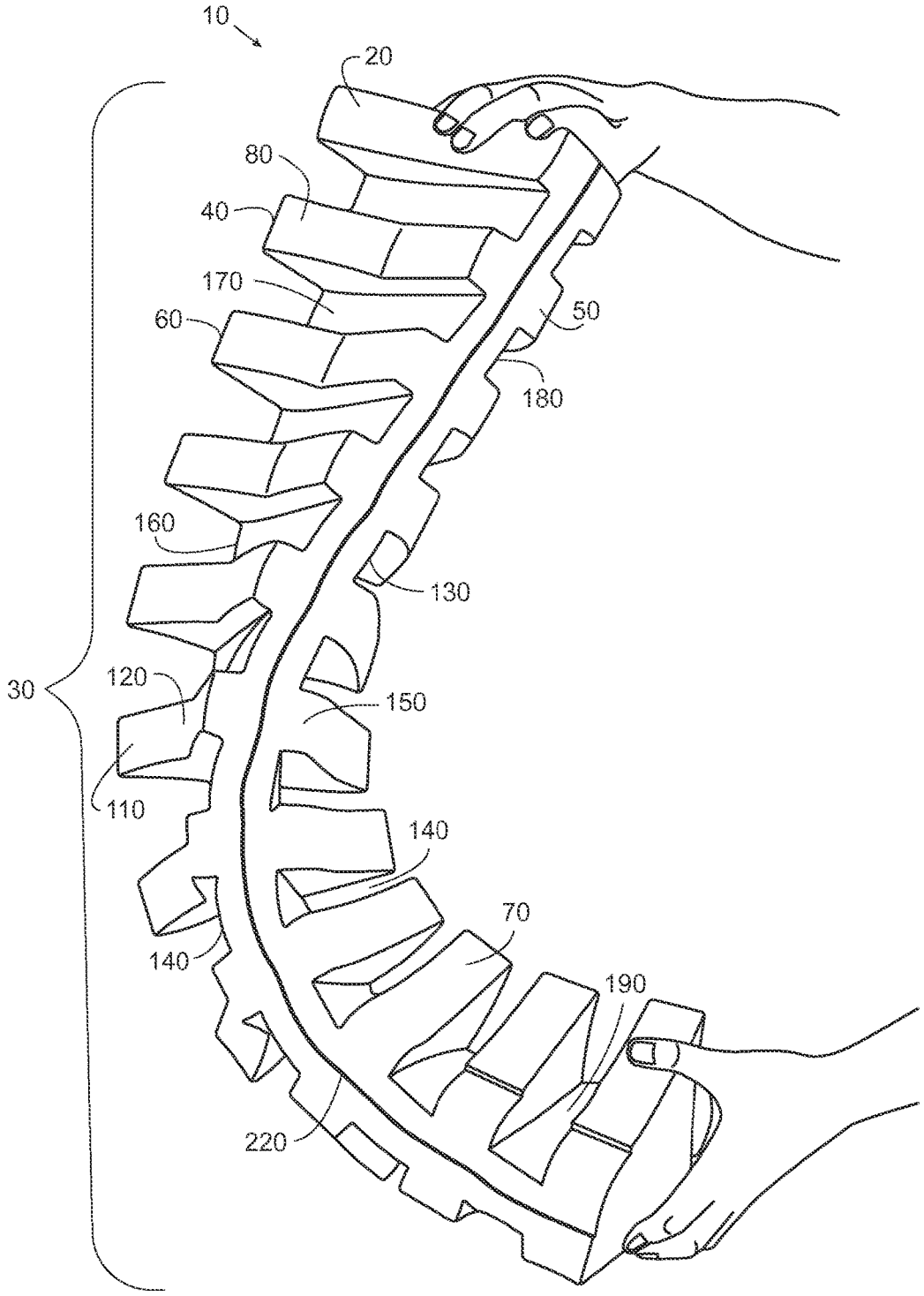
FIG. 1 is a general illustration of a preferred embodiment of the invention.
Figure 2:
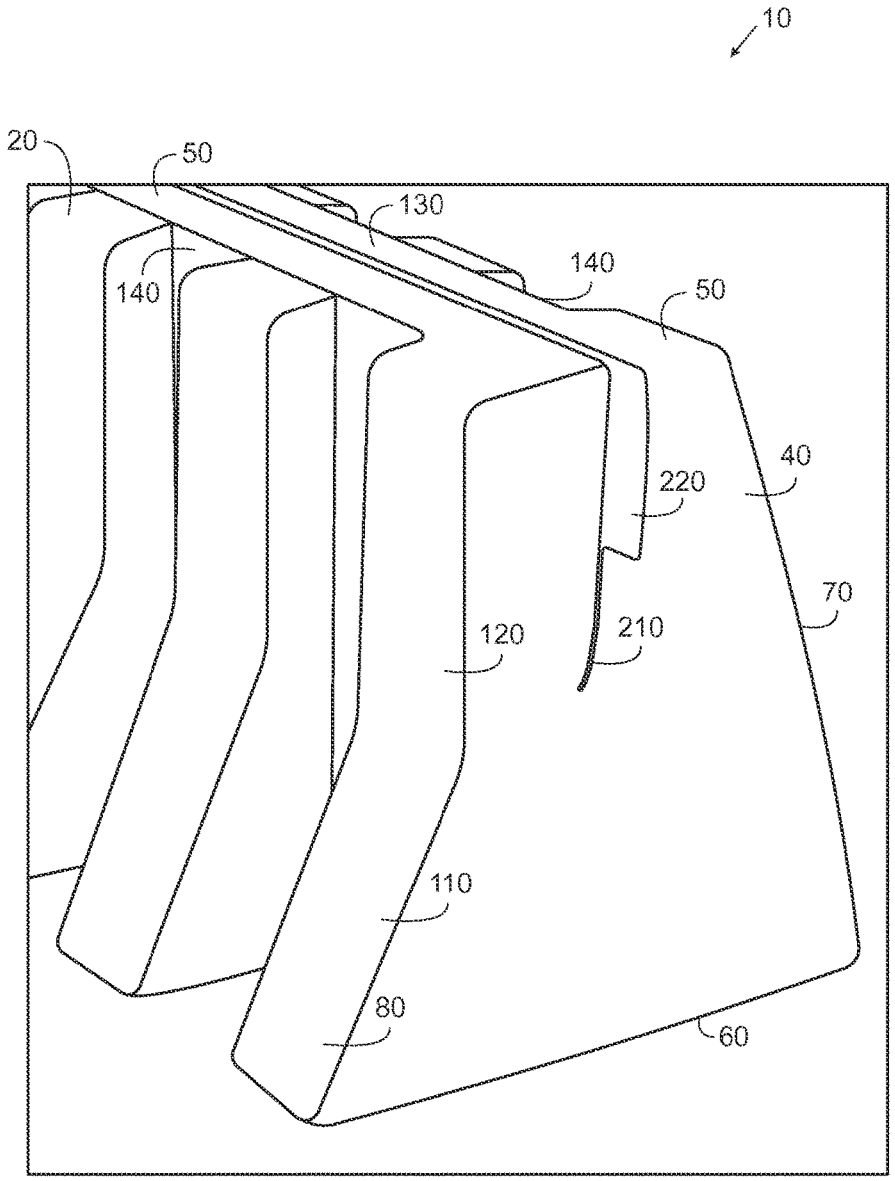
FIG. 2 is a general illustration of a preferred embodiment of the invention.
Figure 3:
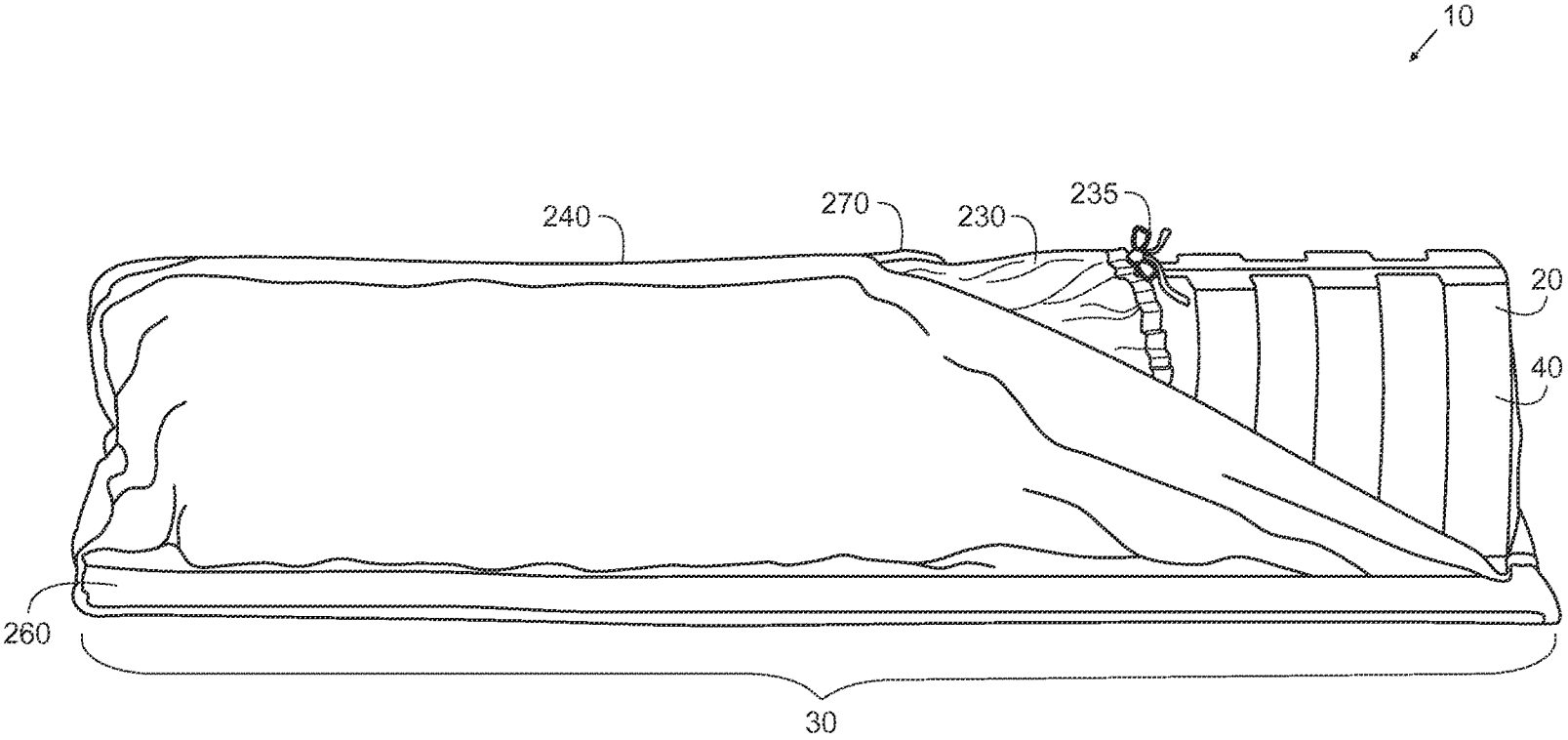
FIG. 3 is a general illustration of a preferred embodiment of the invention.
Figure 4:
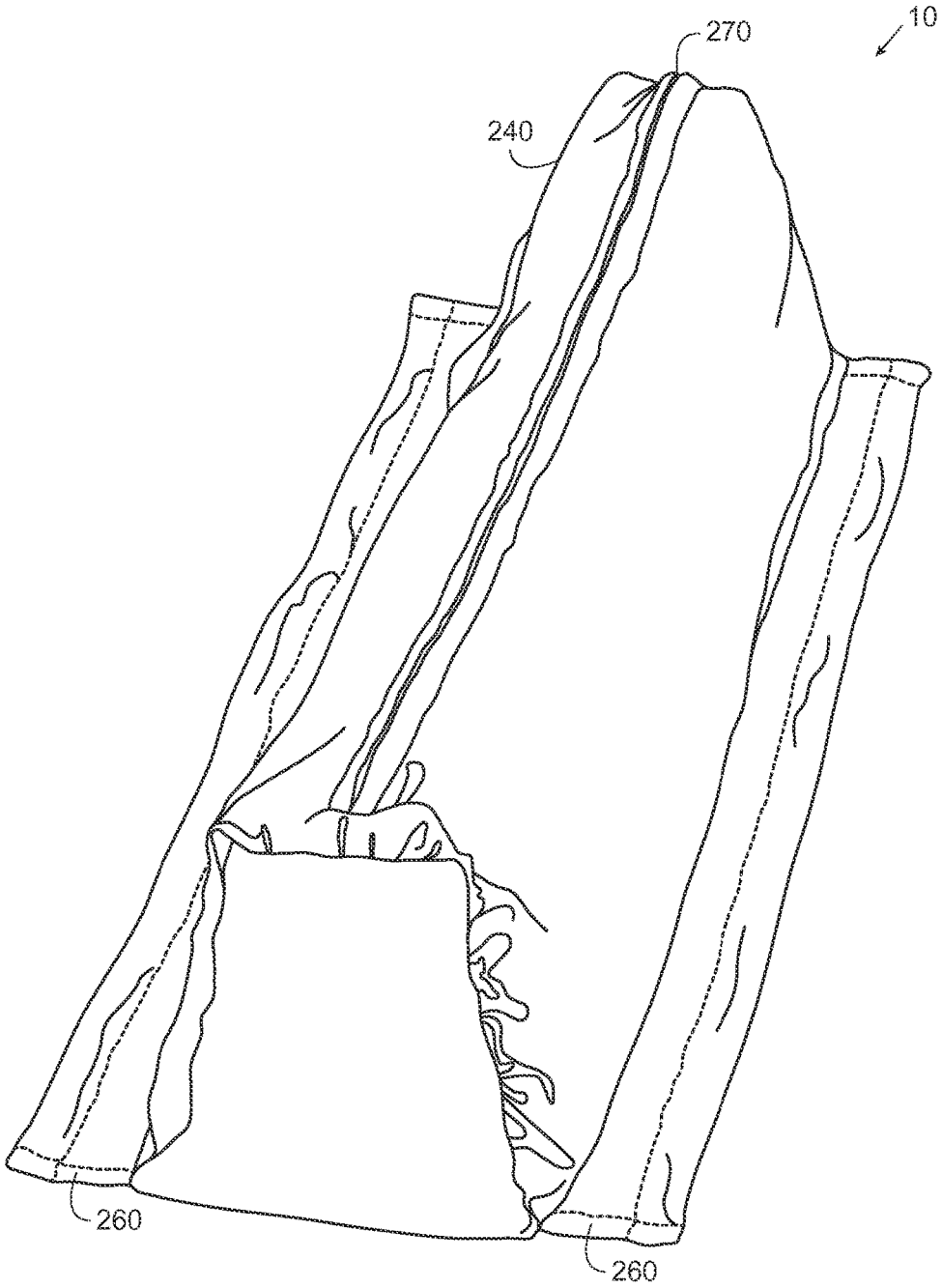
FIG. 4 is a general illustration of a preferred embodiment of the invention.
Figure 5:
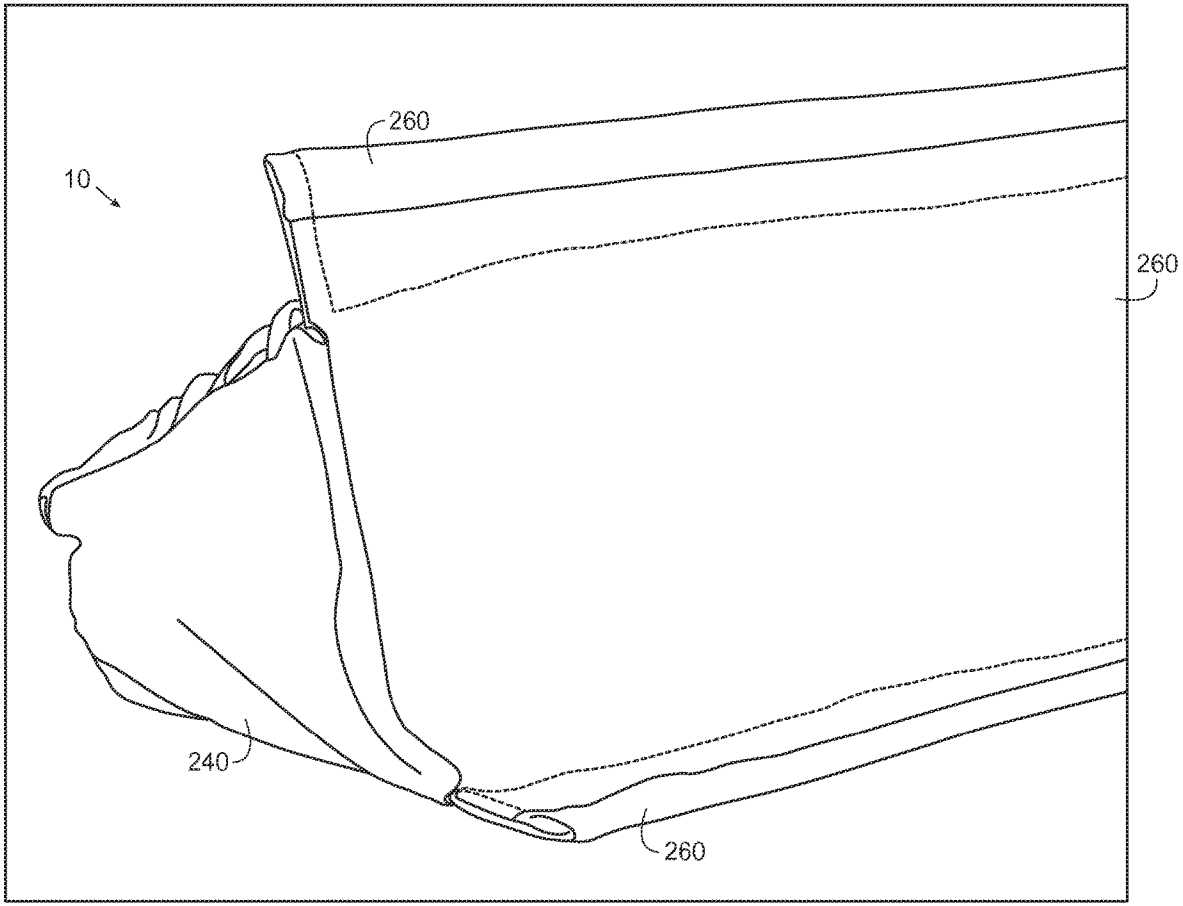
FIG. 5 is a general illustration of a preferred embodiment of the invention.
Figure 6:
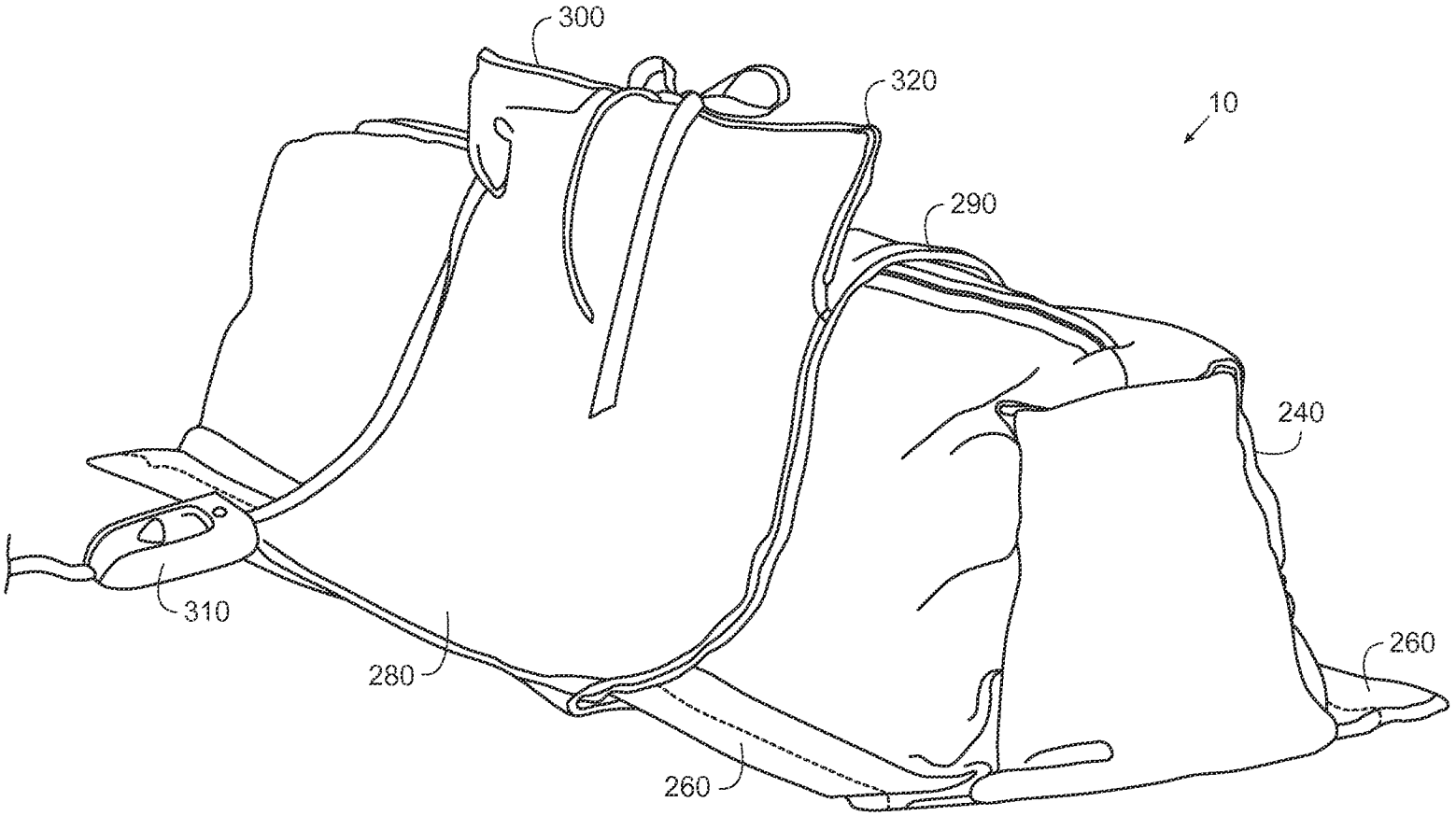
FIG. 6 is a general illustration of a preferred embodiment of the invention.
Figure 7:
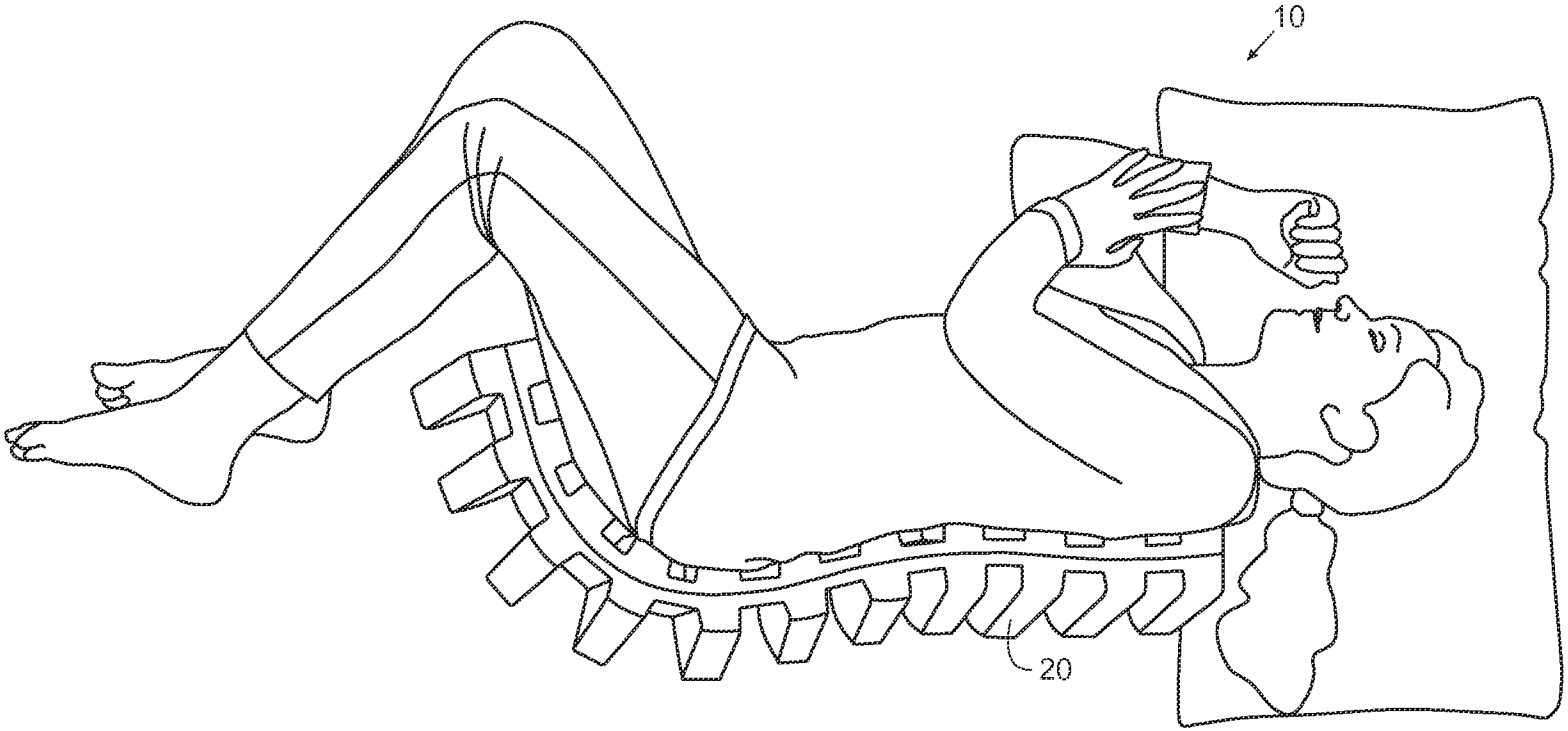
FIG. 7 is a general illustration of a preferred embodiment of the invention.
Figure 8:
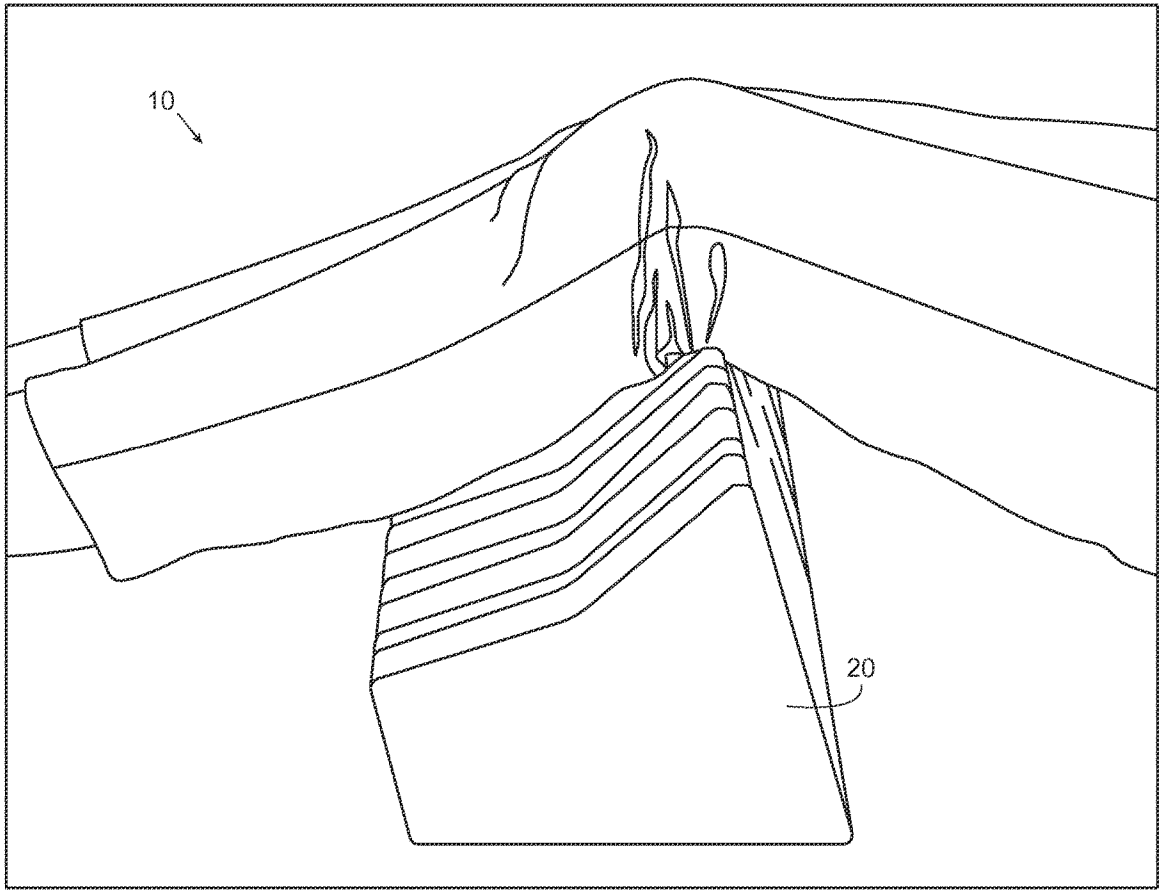
FIG. 8 is a general illustration of a preferred embodiment of the invention.
Figure 9:
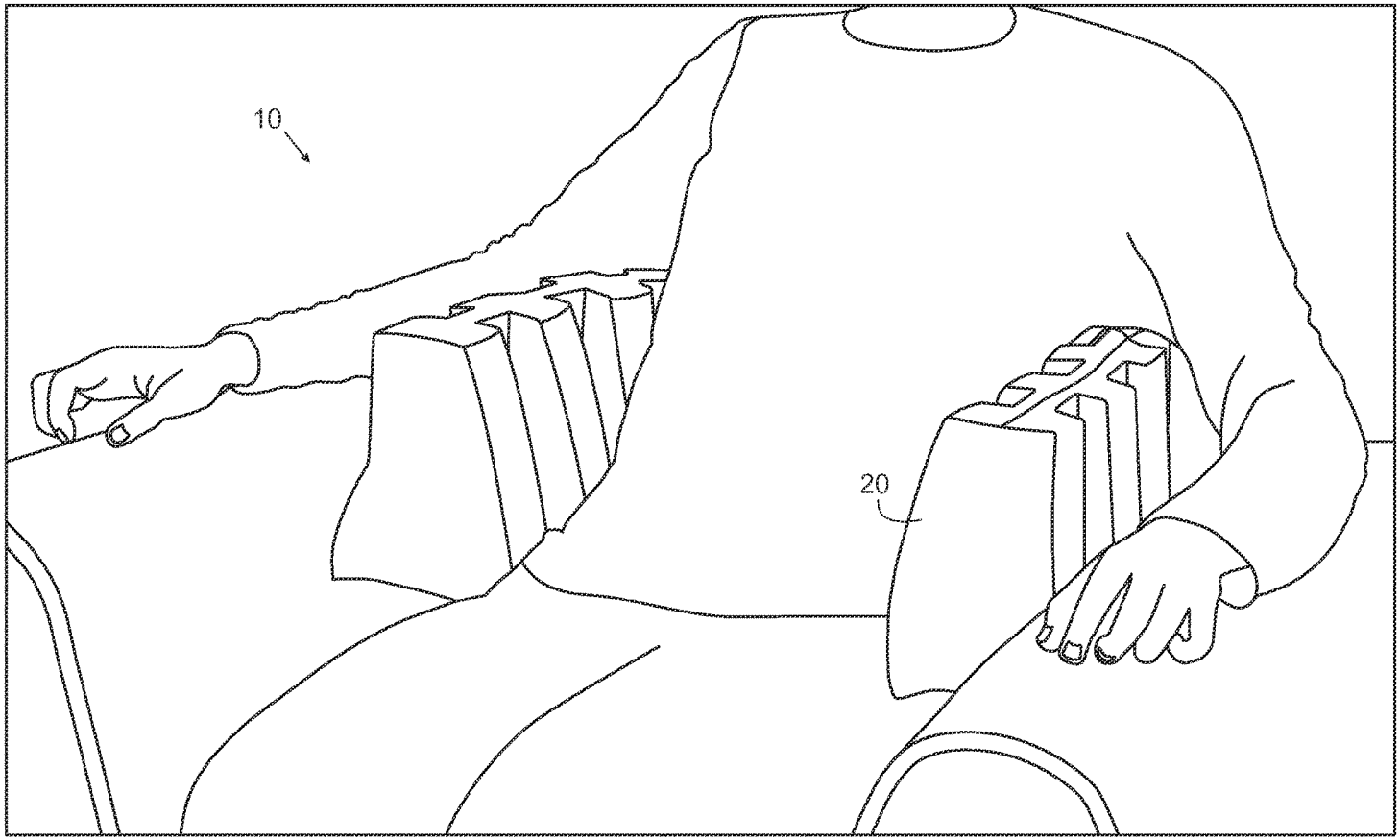
FIG. 9 is a general illustration of a preferred embodiment of the invention.
Figure 10:
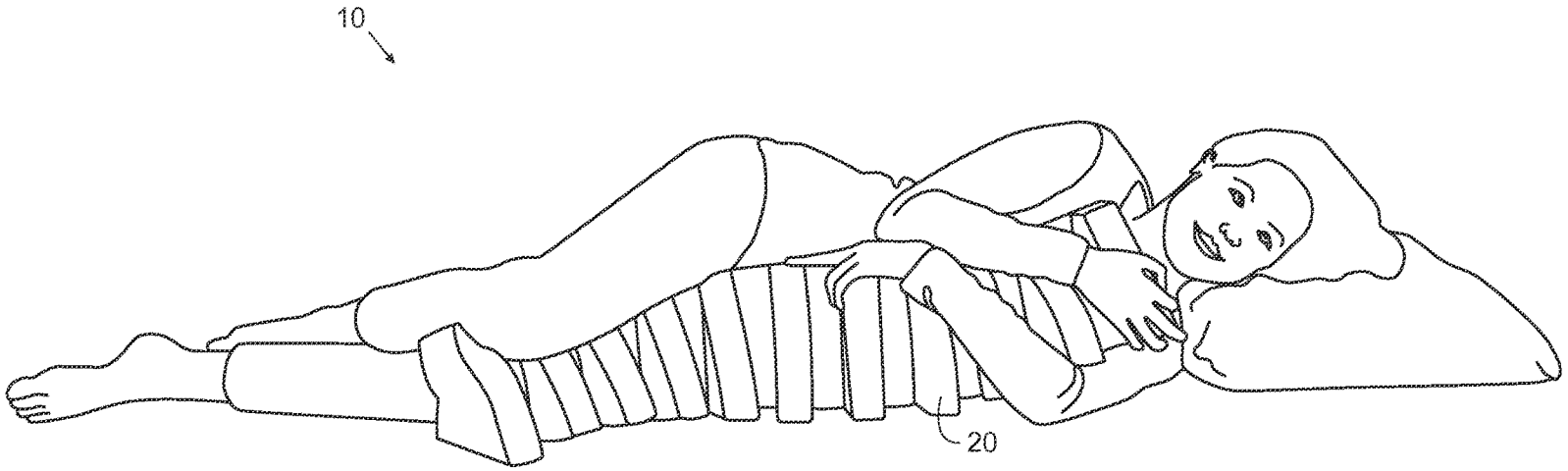
FIG. 10 is a general illustration of a preferred embodiment of the invention.

Referring now to the drawings wherein like reference numerals designate corresponding structure throughout the views, and referring in particular to FIG. 1, reference numeral 10 generally refers to a new and improved system, method and apparatus, hereinafter referred to collectively as invention 10. It is contemplated that invention 10 may comprise a foam spine 20 having a length 30 with a plurality of generally three-dimensional trapezoids interconnected segments 40. Segments 40 may generally have a top 50, a bottom 60, a first side 70, a second side 80, a front 90 and a back 100. It is contemplated that top 50 may be generally parallel to bottom 60.

It is further contemplated that first side may be angled as depicted with a preferred embodiment being 18 degrees as depicted. It is contemplated that second side 80 have a first angled portion 110 and a second angled portion 120 with a preferred embodiment being 18 degrees and 90 degrees as depicted generally forming an obtuse angel. It is understood that the angles, proportions, lengths, and so forth may be greater, lesser, parallel, non-parallel, and so forth. It is generally contemplated that a user may utilize segments 40 first side 70 or second side 80 by preference to the angle desired for support. Furthermore, one slant angle may provide back support when the user may want to tilt more backwards and so forth.

Segments 40 are generally connected by column 130. It is contemplated that foam spine 20 may be made from one piece of open cell foam F40 and channels 140 are generally cut such that segments 40 and column 130 are of a one-piece construction. It is further contemplated that channels 140 may promote airflow between the user and invention 10. This may allow the release of trapped body heat.

Column 130 may further include a top 150, a bottom 160, a first side 170, a second side 180, and a center portion 190. In a preferred embodiment, a slit 200 may be made at top 150 toward center portion 190. This may provide a cavity 210 for adding an internal, spline and or inner support 220 and or spline that may be glued, stuck or otherwise positioned. Inner support 220 may be a non-woven polyester material and may provide structural integrity, strength, and so forth to foam spine 20. It is contemplated that inner support 220 may provide a strengthening element as well as provide lateral and tensile support.

Invention 10 may further include a removable first, inner liner and or inner cover 230, which may be made from reduced friction, water resistant, cleanable, material. Inner cover 230 may utilize a drawstring 235. It is understood that numerous types of material and closing devices are contemplated for inner cover 230.

Invention 10 may further include a removable second or outer cover 240 that may comprise a non-slip and or slip resistant surface and or bottom 250 and or grip wings 260. It is contemplated that non-slip bottom 250, grip wings 260, and combinations thereof provide a means for generally securing foam spine 20 into the desired position. Grip wings 260 may be generally adapted to communicate with the user's body such that the user generally lies on grip wing 260 and thereby trapping foam spine 20 from moving away from user. It is contemplated to utilize polyester woven fabric with a PVC coating sold by the trademark name "EASTEX Products Slip-Not® fabric."

Outer cover 240 may generally be utilized with or without inner cover 230 and inner cover 230 may be generally utilized with or without outer cover 240. Outer cover 240 may have a closable opening 270 for removing foam spine 20 as known in the art. It is contemplated that closable opening 270 may include a zipper, snaps, VELCRO, and so forth.

In a preferred embodiment, invention 10 may include a heating and or cooling system 280 that may comprise a sleeve 290 that may be adapted to slip generally over foam spine 20. It is also contemplated that sleeve 290 may be adapted to slide over outer cover 240, inner cover 230, and combinations thereof. Sleeve may be made from a washable fabric and may further include a pouch 300 for removabaly placing a heating pad 310, a cooling element and or ice pack 320, combinations, thereof as well as other therapeutic devices such as but not limited to massaging elements (not depicted). It is also contemplated that invention 10 may utilize heat insulating fabric with heat reflective facing.

Invention 10 may further utilize:

| Item | Brand | Description |
|---|---|---|
| Polyurethane Foam | Carpenter | Foam Block |
| Polyester Spline | OXCO, Inc | Non-Woven Polyester Fabric |
| Polyester woven fabric With PVC coating | EASTEX Products | Slip-Not ® fabric ™ |
| Outside cover | Hancock Fabric | Ponteroma Knit or Cotton Sateen fabric |
| Inside cover | Hancock Fabric | 60/40 cotton-polyester knit |
| Waterproof cover | Precision Custom Coatings | Woven polyester fabric with Proprietary fluid proof coating |
| Heating pad cover | Hancock Fabric | Ponteroma Knit or Cotton Sateen fabric |
| Heat insulating barrier | Innovative Insulation Inc. | Temptrol ® Heat reflecting fabric |

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

I claim:

1. An ergonomic support system comprising:

a foam spine having a length with a plurality of three-dimensional trapezoid interconnected segments and a column with channels between said segments generally cut such that said segments and said column are of a one-piece construction, wherein said segments have a top, a bottom, a first side, a second side, a front, a back and wherein said top is parallel to said bottom;

an inner support inserted into said length of said foam spine; and a removable cover adapted to fit over said foam spine having a bottom with a slip reducing surface and grip wings, wherein said grip wings are adapted to communicate with the body of a user such that said user generally lies on said grip wings thereby trapping said foam spine from moving away from said user.

2. The system of claim 1 further includes a heating pad in communication with said removable outer cover.

3. The system of claim 1 further including a removable inner liner cover adapted to fit between said foam spine and said removable outer cover.

4. The system of claim 1 wherein said inner support is made of a non-woven polyester.

5. The system of claim 1 wherein said segments first side includes an obtuse angle.

6. The system of claim 1 wherein said segments second side includes an obtuse angle.

* * * * *